US005208565A

United States Patent [19]

Sogo et al.

[11] Patent Number: 5,208,565

[45] Date of Patent: May 4, 1993

[54] DIELECTRIC FILER HAVING A DECOUPLING APERTURE BETWEEN COAXIAL RESONATORS

[75] Inventors: Hiroyuki Sogo; Yasuyuki Kondo, both of Tochigi; Kazuhisa Yamazaki, Shizuoka; Junji Konda, Aichi; Shigemitsu Suzuki, Shizuoka, all of Japan

[73] Assignees: Fujitsu Limited, Kanagawa; Fuji Electrochemical Co., Ltd., Tokyo, both of Japan

[21] Appl. No.: 662,199

[22] Filed: Feb. 28, 1991

[30] Foreign Application Priority Data

| | | | |
|---|---|---|---|
| Mar. 2, 1990 | [JP] | Japan | 2-51223 |
| Mar. 2, 1990 | [JP] | Japan | 2-51224 |
| Mar. 3, 1990 | [JP] | Japan | 2-21685[U] |
| Mar. 3, 1990 | [JP] | Japan | 2-52481 |

[51] Int. Cl.[5] ..... H01P 1/202

[52] U.S. Cl. ..... 333/206; 333/207

[58] Field of Search ..... 333/202, 206, 207, 222, 333/223, 235

[56] References Cited

U.S. PATENT DOCUMENTS

| | | | |
|---|---|---|---|
| 4,757,288 | 7/1988 | West | 333/202 X |
| 4,987,393 | 1/1991 | Yorita et al. | 333/202 |

FOREIGN PATENT DOCUMENTS

| | | | |
|---|---|---|---|
| 0312011 | 4/1989 | European Pat. Off. | 333/202 |
| 0015401 | 1/1986 | Japan | 333/206 |
| 0179603 | 8/1986 | Japan | 333/222 |
| 0237501 | 10/1986 | Japan | 333/202 |
| 0038601 | 2/1987 | Japan | 333/202 |
| 0043904 | 2/1987 | Japan | 333/202 |
| 0055402 | 2/1990 | Japan | 333/202 |

*Primary Examiner*—Paul M. Dzierzynski
*Assistant Examiner*—Seung Ham
*Attorney, Agent, or Firm*—Keck, Mahin & Cate

[57] ABSTRACT

A dielectric resonator with a dielectric block. The block has a plurality of resonance apertures and coupling-prevention aperture between the adjacent resonance apertures within the block. The block is entirely coated with a conductive film except a limited portion around the one end of the resonance apertures.

6 Claims, 11 Drawing Sheets

DIELECTRIC FILER HAVING A DECOUPLING APERTURE BETWEEN COAXIAL RESONATORS

BACKGROUND OF THE INVENTION

The present invention relates in general to a dielectric resonator applicable primarily to microwave bandpass, not limited thereto, and a filter using the dielectric resonator, and more particularly to a ¼ wavelength multi-stage coaxial resonator of a unitary structure, and a band-pass filter (BPF) and a band-rejection filter (BRF) using such multi-stage coaxial resonator.

Various types of structure of multi-stage filters using high dielectric constant ceramic materials are known. One of the conventional multi-stage filters is shown in FIG. 30A, in which a plurality of (three in FIG. 30A) dielectric rectangular resonators 10 are combined in sidewise coupling arrangement by means of suitable lumped element circuits such as capacitors, coils, etc. In FIG. 30A, the dielectric resonator 10 has a through-hole 14 serving as a resonator hole for resonation at a center of each of the rectangular columns of high dielectric constant material, and a conductive film adhered to outer surfaces of the column except the upper, "open" surface thereof, as well as on an inner surface of the through-hole 14. For the purpose of clarification, the conductive film on the outer surface as above is referred to as an "outer conductor" and the conductive film on the inner surface of the through-hole to a "central conductor". Capacitors $C_1$, $C_2$, $C_3$ are connected to the central conductors at the open surface (upper surface) with coils $L_1$, $L_2$ connected between the capacitors. FIG. 30B shows an electric circuit equivalent to the structure of FIG. 30A. The dielectric resonator 10 has its own resonance frequency which is determined by such factors as height or length of the rectangular structure, relative dielectric constant, capacitance of the capacitors applied thereto, and a band-rejection filter of ¼ wavelength coaxial resonator. An example of the filter characteristics is shown in FIG. 31.

The coupled construction of separate elements as shown in FIG. 30A can be applied to a band-pass filter and yet in a unitary structure as shown in FIG. 32A has been used in general. In the structure of band-pass filter in FIG. 32A, a rectangular parallelopiped dielectric block 16 is provided with three resonance apertures 18 at a predetermined interval and two coupling apertures 20 in an adjoining relation to the resonance aperture, and the outer surfaces, except the upper open surface, and the inner surface of the resonance aperture 18 are provided entirely with, or covered with, a conductive film. Capacitors 22 are coupled to open ends of the resonance apertures positioned at opposite sides of the central resonance aperture for connection with external circuits and devices. An electric circuit equivalent to the structure of FIG. 32A is shown in FIG. 32B, and this band-pass filter has characteristics as shown in FIG. 33. In FIG. 32B three resonator elements 24, coupling capacitors $C_{01}$, $C_{02}$, at input/output terminals, and coils $L_1$, $L_2$ for connecting the resonator elements 24.

The conventional band-rejection filter shown in FIG. 30A consists of a plurality of (three) resonators arranged in a sidewise abutment relation with greater number of parts and elements for assembly and, consequently, increased number of assembly steps is necessary. Thus strict requirements for positioning the resonators and for accuracy of the outer conductive surfaces must be fulfilled. Further, additional requirements for mechanical strength and environmental resistance reliability with respect to the coupling of the resonators must be fulfilled since the resonators must be bonded together.

The band-pass filter of a unitary structure shown in FIG. 32A does not have the disadvantages as described above with respect to the band rejection filter, but has problems that accuracy in dimension and positioning or pitch of coupling apertures and uniformity of a relative dielectric constant must be maintained so as to minimize the influence on the electro-magnetic properties. Therefore, the band-pass filter structure of FIG. 32A provides considerable difficulties in electromagnetic properties and its design.

SUMMARY OF THE INVENTION

A general object of the present invention is to provide an improvement in a dielectric resonator and a filter incorporating the dielectric resonator.

Another object of the present invention is to provide a new dielectric resonator which has stable electromagnetic properties.

A further object of the present invention is to provide an improvement in production efficiency and assembly of elements of the dielectric resonator and the filter using the dielectric resonator.

Additional object of the present invention is to provide a small-sized dielectric resonator with a minimum dimension in height of a dielectric resonator and a small-sized filter using same.

Another object of the present invention is to provide an improved filter using a dielectric resonator, which permits an adjustment of frequency and couplings without substantial labour or difficulty.

According to the present invention, there is provide a dielectric resonator of a dielectric block, comprising:

a plurality of resonance apertures extending in parallel to each other at a predetermined interval within the dielectric block, an open, or non-conductive, side on the outer surface of the dielectric block, an end of each of the resonance apertures lying on the open side, an electrically conductive film extending entirely along an inner surface of the resonance apertures and the outer surfaces of the dielectric block except a surface of the open side to provide central conductor portions in the resonance apertures and outer conductor portions on the outer surfaces of the dielectric block, thereby forming a multi-stage coaxial resonator, and a decoupling or coupling-prevention aperture between the adjacent resonance apertures for shielding the electromagnetic influence of the adjacent resonance apertures. The decoupling aperture has an electrically conductive film on an inner surface thereof and two openings, and the two openings of the decoupling aperture are electrically connected with the outer conductive portions.

A filter according to the present invention incorporates the dielectric resonator described above and additional suitable lumped element circuits such as a capacitor and a coil.

According to another embodiment of the present invention, the dielectric block has at least one groove on the open side at the position adjacent to the decoupling aperture.

In the present invention, each of the resonance apertures provides a ¼ wavelength coaxial resonator. The apertures formed between the resonance apertures has a surface of an electric conductive film which is electrically connected with the outer conductor portions on the outer surface of the block so that a decoupling aperture is formed to shield a propagation of electromagnetic wave between the resonators and inhibit a electromagnetic coupling thereof. Thus, the unitary structure of the dielectric resonators provides a substantially similar electromagnetic operations as the coupled structure of a plurality of resonators. By adding suitable lumped element circuits, a predetermined band-pass or band-rejection filters can be obtained.

In the embodiment in which groove or grooves are formed on the open side adjacent to the decoupling apertures, a coil for coupling the adjacent resonator elements can be disposed in the grooves so that the dimension or height of a filter can be reduced.

BRIEF DESCRIPTION OF THE DRAWINGS

FIG. 29 is a circuit diagram of the filter shown in FIG. 28, and FIGS. 30A through 33 show the conventional filter structures wherein:

PREFERRED EMBODIMENTS OF THE INVENTION

Figure 1A:
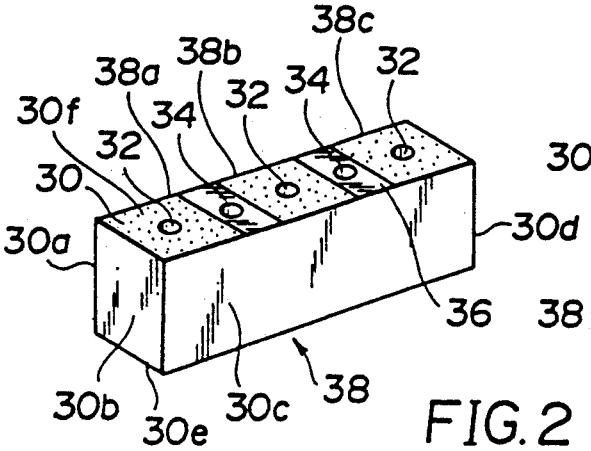
FIG. 1A is a perspective view of a dielectric resonator embodying the present invention.
Figure 1B:
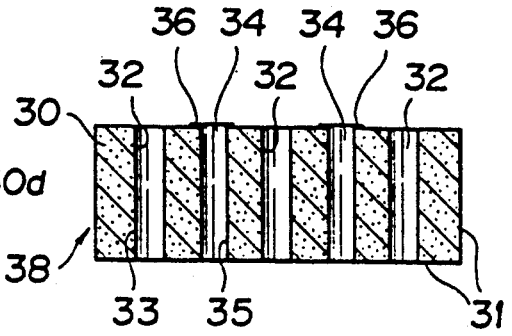
FIG. 1B is a sectional view of the resonator shown in FIG. 1A.

Referring to FIGS. 1A and 1B showing a three-stage dielectric resonator, a dielectric block 30 of a rectangular parallelopiped shape has three resonance apertures 32 extending in parallel at a constant interval. An electrically conductive film is disposed on a surface of the aperture wall of the resonance apertures 32 to form a conductive portion (hereinafter referred to as central conductor portion 33) and, similarly, an electrically conductive film is disposed entirely on the four sides 30*a*, 30*b*, 30*c*, 30*d* and bottom side 30*e* of the dielectric block 30 to form another conductive portion (hereinafter referred to as outer conductor portion 31). The upper side or top of the block 30 which is not provided with the conductive film constitute an "open side" 30*f*, and the bottom side 30*e* constitutes a short-circuit or ground side. The dielectric block 30 is preferably made of a sintered high dielectric constant material such as barium titanate.

In the present invention, coupling-prevention, or decoupling apertures 34 are provided between the resonance apertures 32 and an electrically conductive film 35 is disposed on an interior of the decoupling apertures 34. The conductive film 35 of the decoupling apertures 34 are electrically connected with the aformentioned outer conductor portion 31 at the opposite ends of each decoupling aperture 34. The bottom of the dieletric block 30 is entirely covered with the conductive film and thus the bottom is directly connected with the conductive layer of the interior of the decoupling aperture 34. The open side (i.e., non-conductive side) is formed on the upper surface conductive film zones 36 as illustrated in FIG. 1A so that the conductive film 35 of the interior of the decoupling aperture 34 is electrically connected with the outer conductor portion 31 on the sides of the dielectric block 30. Thus, a predetermined multi-stage resonator is obtained. The conductive films such as the films 31, 33, 35, 36 are very thin films of, for example, baking silver paste.

The decoupling aperture 34 positioned between the resonance apertures 32 is coated with the conductive film 35 so that the conductive film 35 is electrically connected with the outer conductor portion 31 at the opposite open ends of the decoupling aperture 34. Thus, an electromagnetic wave propagation between the adjacent resonator portions 38*a*, 38*b*, 38*c* is shielded desirably to provide an integrally formed electromagnetic structure which is electromagnetically equivalent to a structure of three separate resonators.

Figure 2:
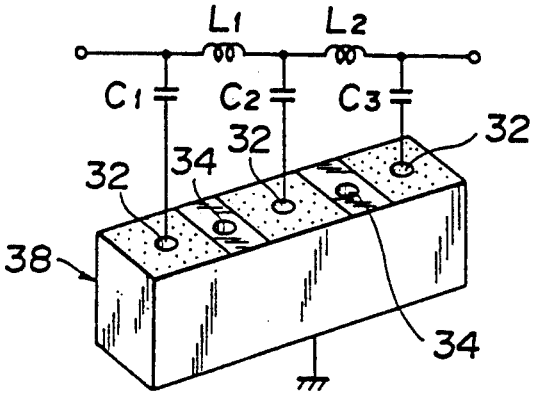
FIG. 2 is a diagram showing a band-rejection filter (BRF) incorporating the dielectric resonator shown in FIGS. 1A and 1B, FIG. 3, similar to FIG. 2, is a diagram of a band-pass filter (BPF)
Figure 3:
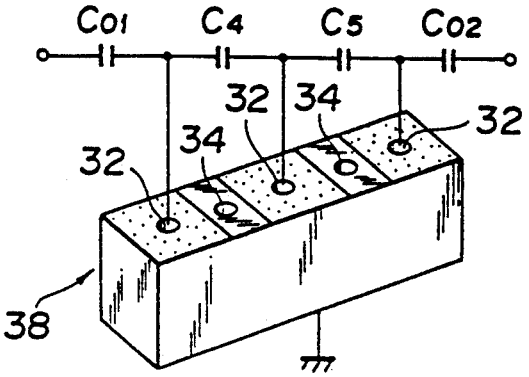

Suitable electrical elements can be added to the thus formed resonator to provide a filter. As illustrated in FIG. 2 a band-rejection filter can be formed by providing capacitors $C_1$, $C_2$, $C_3$ to the resonator elements 38a, 38b, 38c and coils $L_1$, $L_2$ between the capacitors $C_1$, $C_2$, $C_3$. Similarly, a band-pass filter can be obtained by connecting coupling capacitors $C_{01}$, $C_{02}$ to the resonator elements 38a, 38b, 38c and capacitors $C_4$, $C_5$ or otherwise coils between the resonator elements as illustrated in FIG. 3.

FIGS. 4 through 9 show several modified structure of the dielectric resonator according to the present invention.

Figure 4:
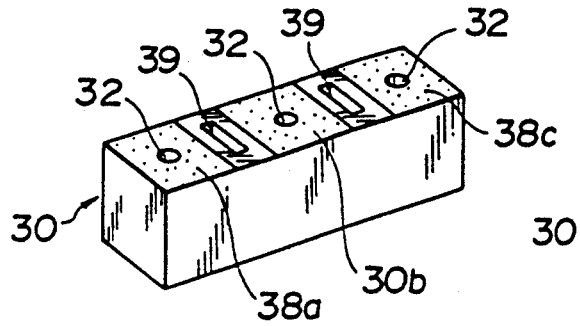
FIGS. 4 through 9 are perspective views of the dielectric resonator according to additional embodiments of the invention.

FIG. 4 shows a modification in which a rectangular aperture 39 is formed between the adjacent resonance apertures 32 in place of the round-shaped aperture 32 in the previous embodiment of FIG. 1A. The rectangular shape of the aperture 39 can reduce a cross sectional area of the dielectric material between the adjacent resonator elements 38a, 38b, 38c, with the result that the propagation of electromagnetic wave can be minimized and consequently the electromagnetic shield effect can be improved.

Figure 5:
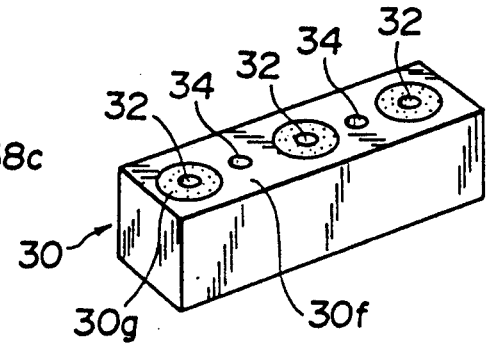

In FIG. 5, the dielectric block 30 having round shaped decoupling apertures 34 and resonance apertures 32 is entirely coated with a conductive film on six sides of the block except a limited portion 30g adjacent to the upper open end of the resonance apertures 32 on the upper surface 30f of the block. A ring like uncoated, non-conductive area of portion 30g is shown. This structure provides an improvement in Q value and can be obtained simply by dipping the dielectric block into a silver paste and them removing a masking from the position adjacent the upper open end of the resonance apertures without using an expensive screen printing technique.

Figure 6:
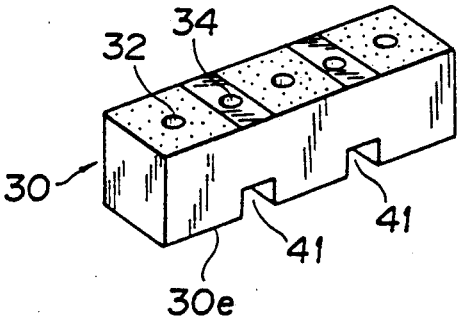
Figure 7:
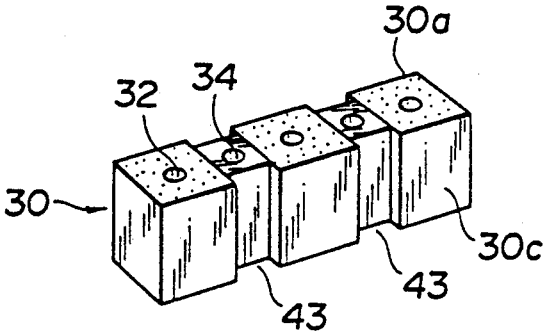
Figure 8:
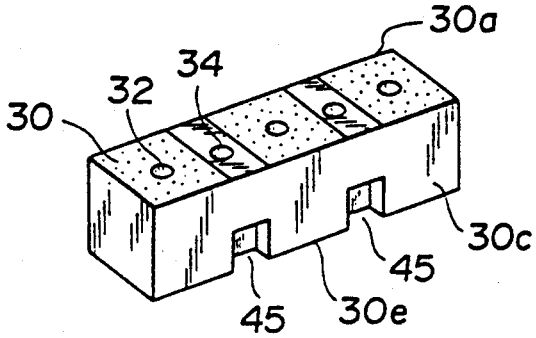
Figure 9:
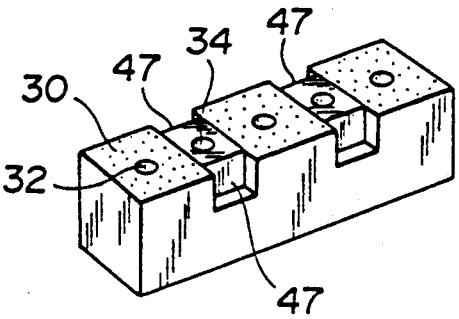

FIGS. 6 through 9 show other modifications in which a recess or groove is formed at a portion adjacent to the decoupling apertures 34 in order to reduce the electromagnetic coupling between the adjacent resonator elements by reducing the sectional area of the dielectric material adjacent to the decoupling apertures by means of the recess or groove. In the modification of FIG. 6, grooves 41 are formed on the ground side 30e, adjacent to the lower end of the decoupling apertures 34. In the modification of FIG. 7, grooves 43 are formed on opposite sides 30a and 30c of the block, along the longitudinal direction of the decoupling apertures 34. In FIG. 8, recesses 45 are formed on the longitudinal side 30a, 30c of the block, at the ground side 30e of the block 30, though the recesses 45 on only one side 30e are shown. FIG. 9 shows the modification in which recesses 47 similar to those of FIG. 8 are formed on the upper and longitudinal sides of the block.

Figure 10A:
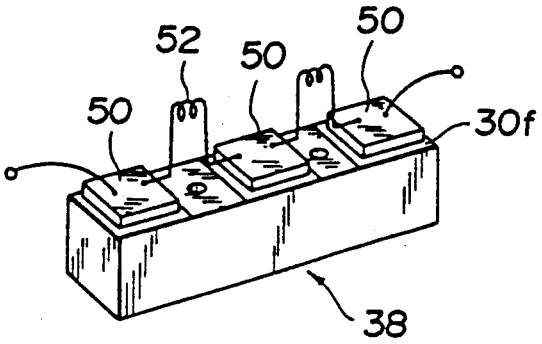
FIG. 10A is a perspective view of a dielectric filter according to the present invention.
Figure 10B:
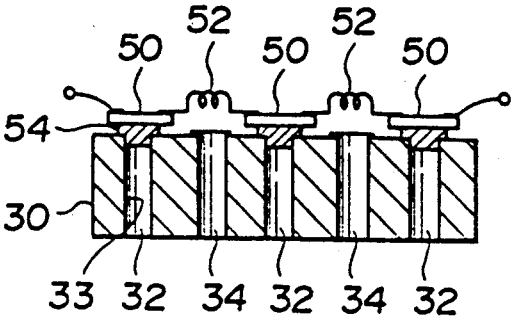
FIG. 10B is a sectional view of the dielectric filter shown in FIG. 10A.

In FIGS. 10A and 10B showing a specific example of a dielectric filter shown in FIG. 2, plain capacitors 50 are mounted on open ends 30f of the resonance apertures 32 and the capacitors 50 are connected to each other by coils 52. In the illustrated embodiment, a rivet-like metal terminal 54 is fitted into each of the resonance apertures 32 and soldered to the central conductor portions in the apertures 32 and the capacitors are fixed by soldering to the capacitors 50. The rivet like terminal 54 facilitates easy connection of the capacitors.

Figure 11:
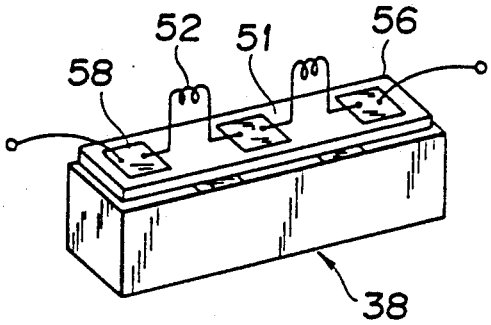
FIG. 11 is a perspective view of a dielectric filter according to another embodiment of the invention.
Figure 12:
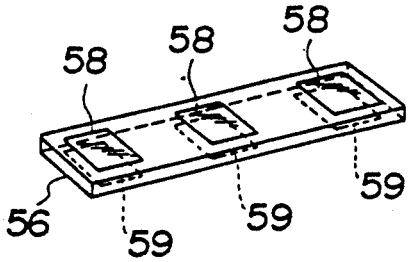
FIG. 12 is a perspective view of a capacitor substrate applicable to the dielectric filter shown in FIG. 11.

FIGS. 11 and 12 shows a modified structure of the dielectric filter, in which a single substrate 51 having upper electrodes 58 and lower electrodes 59, which are formed in alignment with the resonance apertures 32 (FIG. 10B) is used. The substrate 51 is mounted on the dielectric resonator 38 and the lower electrodes 59 are electrically connected with the central conductor portions 33 in the resonance apertures 32. The upper electrodes 58 are connected to each other by coils 52.

Figure 13:
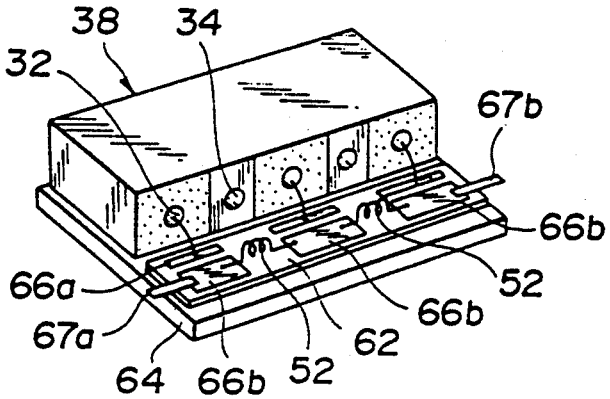
FIG. 13 is a perspective view of a dielectric filter according to still another embodiment of the invention.
Figure 14A:
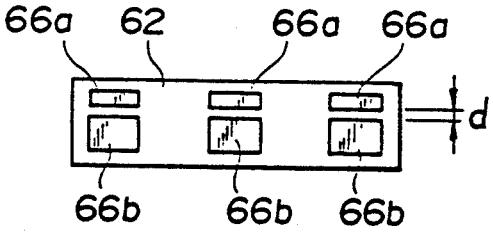
FIGS. 14A and 14B are plan views of a capacitor substrate applicable to the dielectric filter shown in FIG. 13.
Figure 14B:
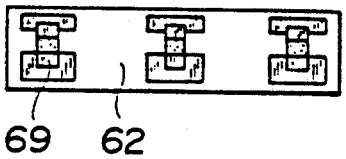

FIG. 13 shows a further embodiment in which the dielectric resonator 38 and the capacitor substrate 62 are mounted on a base plate 64. The substrate 62 has a plurality of capacitor portions and provides a capacitor capacitance by a distance d (FIG. 14A). Each central conductor portion 33 of the dielectric block 30 (FIG. 10B) is connected with the electrode 66a in one row, and other electrodes 66b of the other row are connected together by coils 52. Reference numerals 67a and 67b represent input and output terminals, respectively. The capacitor substrate can be of the type having a tip capacitor 69 mounted between the electrodes 66a, 66b as shown in FIG. 14B.

Figure 15A:
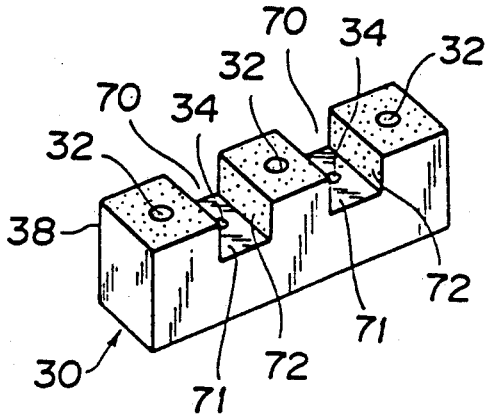
FIG. 15A is a perspective view of a dielectric resonator according to a further embodiment of the invention.
Figure 15B:
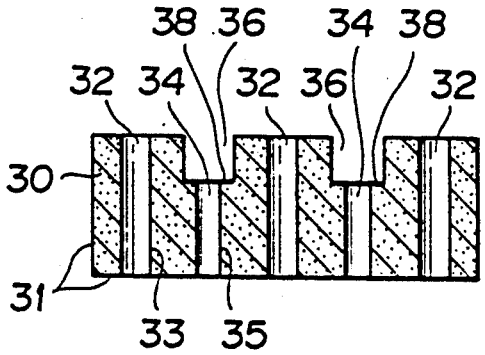
FIG. 15B is a sectional view of the dielectric resonator shown in FIG. 15A, FIGS. 16 and 17 are front views of a band-rejection filter (BRF) and a band-pass filter (BPF), respectively, incorporating the dielectric resonator shown in FIGS. 15A and 15B, FIGS. 18 and 19 show modified structure of the dielectric resonator, especially that of FIG. 15A, according to the invention.
Figure 16:
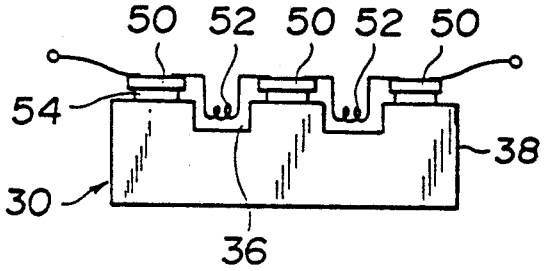
Figure 17:
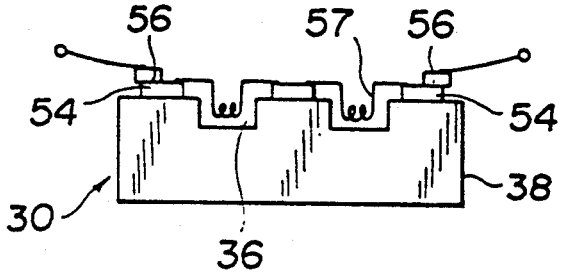

FIGS. 15A and 15B show a dielectric resonator 38 according to another embodiment of the invention. The dielectric block 30 is similar to that of FIG. 1A but has, at the position of the upper end of the decoupling apertures 34, and grooves 70 extending in a widthwise direction. The four sides and bottom surface of the dielectric block 30 are coated with a conductive film as similar as the previous embodiment, but in this embodiment the walls in the grooves 70, 72 are not coated with the conductive film. It is readily appreciated that the dielectric block 30 in FIGS. 15A and 15B can be used to form band rejection and band-pass filters as shown in FIGS. 16 and 17, respectively, by applying electric circuits as shown in FIGS. 2 and 3. In FIGS. 16 and 17, reference numeral 50 represents plain capacitors, 52 and 57 coils, and 56 input/output coupling capacitors.

Figure 18:
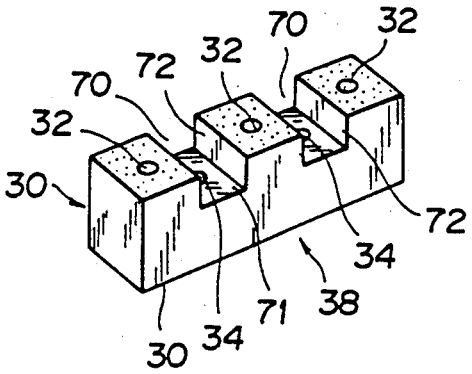
Figure 19:
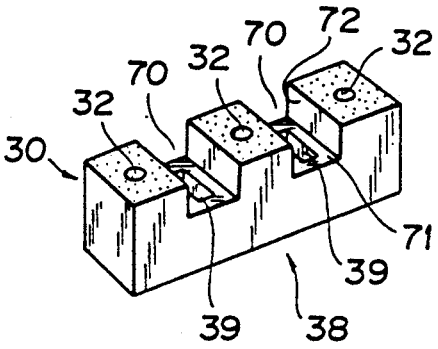

FIGS. 18 and 19 show other modifications of the dielectric block 30. In the embodiment of FIG. 18, the conductive film is coated on not only the bottom 71 of the grooves 70 but also the side walls 72. If necessary, all the surfaces of the dielectric block 30 can be coated with a conductive film except a very small area around the upper end of the resonance apertures 32 in order to improve Q value. In the embodiment of FIG. 19, elongated rectangular decoupling apertures 39, which are similar to the apertures 39 of FIG. 4, are formed at the grooves 70. The decoupling aperture 39 is elongated so that it extends in a widthwise direction of the dielectric block 30. This structure of FIG. 19 provides an improvement in shield effect of the electromagnetic wave since a cross sectional of the dielectric material area between the adjacent resonator elements is reduced by the elongated rectangular decoupling apertures 39.

FIGS. 20 through 23 show an example of a band-rejection filter incorporating the dielectric resonator 38 described hereinbefore. The band-rejection filter has a capacitor substrate 51 with suitable lumped element circuits totally or partly mounted thereon and the dielectric resonator adapted to a recess or a shoulder 80 formed on the side of the dielectric resonator 38.

Figure 20:
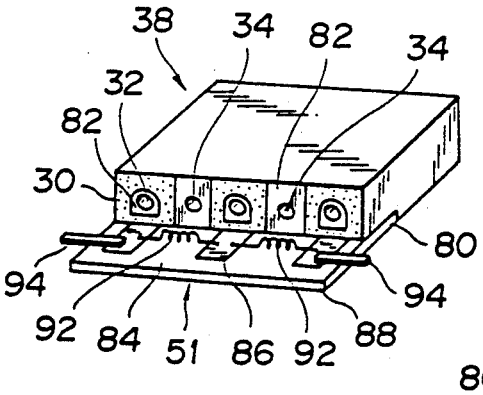
FIGS. 20 and 21 show a dielectric band-rejection filter (BRF) according to the present invention.
Figure 21:
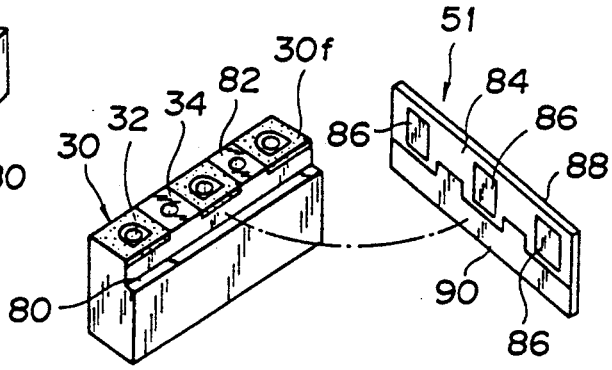
Figure 22:
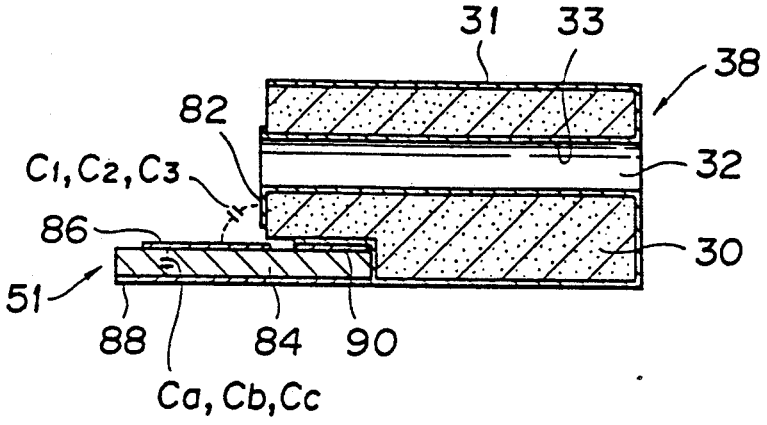
FIG. 22 is a sectional view of the filter shown in FIGS. and 21.

In FIGS. 20–22, the dielectric block 30 has a longitudinal shoulder 80 on one longitudinal edge of the opened side, and is coated entirely with an electrically conductive film except the interior of the open side 30f(i.e., upper side of FIG. 21). As is similar to the previous embodiments, the conductive film on the interior of the resonance apertures 32 is referred to as a central conductor portion 33, and the conductive film covering substantially the sides of the block except the open side 30f is referred to an outer conductive portion 31. A conductive pattern 82 is disposed adjacent to the decoupling apertures 34 on the open side 30*f* to connect the conductive film portion 35 with the outer conductive film portion 31, and the conductive film portion 35 of the decoupling apertures 34 is grounded at its both ends by the connection with the outer conductive film portion 31.

The capacitor substrate 51 has a dielectric plate 84 having a length substantially equal to the length of the dielectric resonator 38, three surface electrodes 86 and a back grounded electrode 88, the both electrodes 86 and 88 being disposed on the dielectric plate 84, and a longitudinal pattern 90 connected to the conductive film formed on the shoulder 80 of the dielectric resonator 38. The surface electrodes 86 are connected to each other by coils 92 and two of them are connected to input/output terminals 94.

Figure 23:
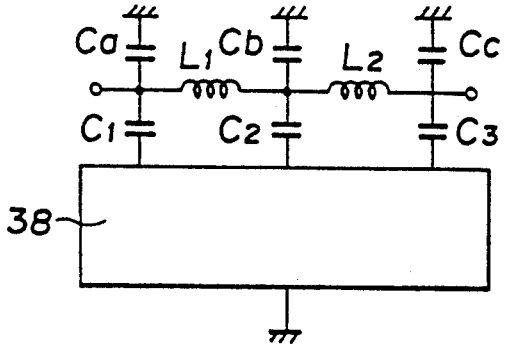
FIG. 23 is a circuit diagram of the band-rejection filter shown in FIGS. 20–22.
Figure 24:
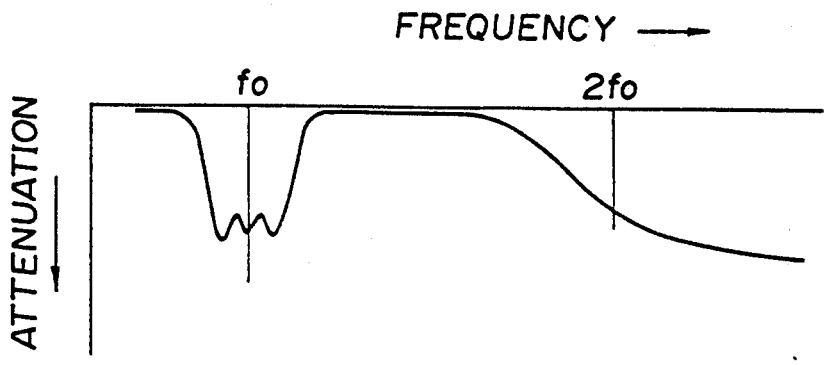
FIG. 24 is a graph of a filter characteristic of the filter show in FIG. 23, FIGS. 25A and 25B show a dielectric band-rejection filter according to another embodiment of the invention.

The conductor pattern 82 adjacent to the resonance apertures 32 on the open side 30*f* of the dielectric block is located at right angles to the surface of the surface electrodes 86 of the capacitor substrate 51 to form a coupling capacitance. An electric circuit equivalent to the coupling capacitance is shown in FIG. 23. The equivalent circuit has grounded capacitors Ca, Cb, Cc, coupling capacitors $C_1$, $C_2$, $C_3$ and coils $L_1$, $L_2$ to realize a dielectric band-rejection filter. By selectively determining the grounded capacitors in accordance with the dielectric constant and thickness of the dielectric plate 84 and the area of the surface electrodes 86, an attenuation characteristic in the frequency range above a secondary resonance frequency (2fo) can be improved as shown in FIG. 24.

The shoulder 80 of the dielectric block 30 is formed to meet with the thickness of capacitor substrate 51 so that a unitary structure of the both elements 30, 51 can be performed with ease.

Figure 25A:
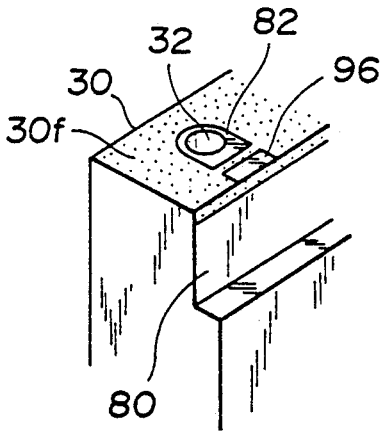
Figure 25B:
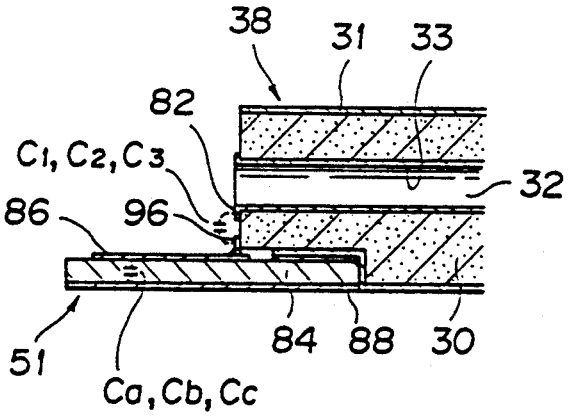

Various formation of the coupling capacitors can be made. In FIGS. 25A and 25B, a non-conductive gap is formed between conductive patterns 82 and 96 formed adjacent to the resonance aperture 32 on the open side 30*f* of the dielectric block 30 to provide a coupling capacitance. The conductive pattern 96 extends along the edge of the dielectric block 30 and is connected by soldering with the front electrode 86.

Figure 26A:
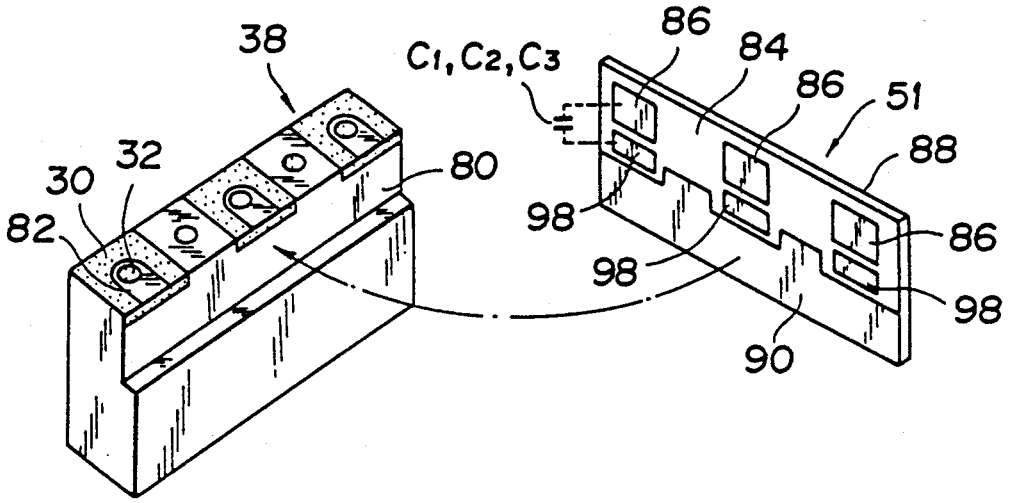
FIGS. 26A and 26B show a dielectric band-rejection filter according to a further embodiment of the invention.
Figure 26B:
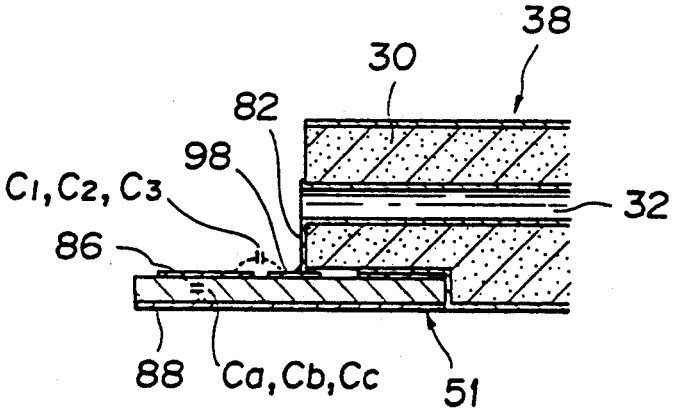
Figure 27A:
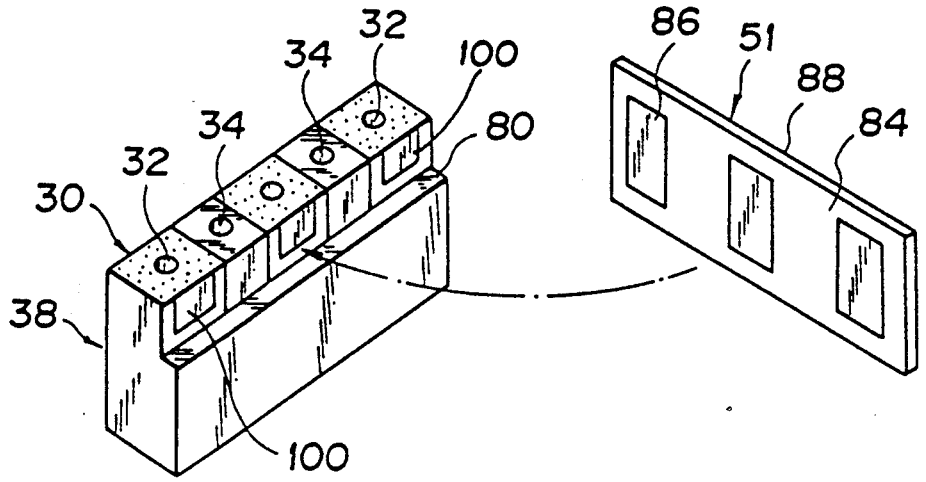
FIGS. 27A and 27B show additional embodiment of the invention.
Figure 27B:
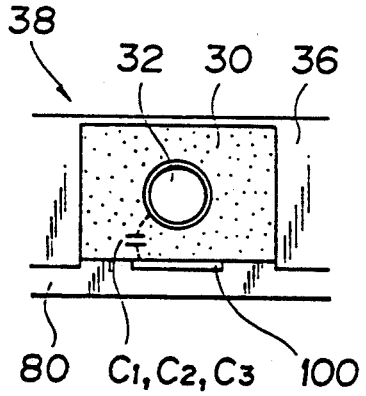

FIGS. 26A and 26B show an example of modified structure in which also coupling capacitors are formed to the capacitor substrate 51. The capacitor substrate 51 has first set of surface electrodes 86 and second set of surface electrodes 98 with a gap therebetween to thereby realize a coupling capacitance as illustrated. In this structure, the dielectric block 30 has conductive patterns 82 which extend to the edge of the dielectric block 30 and connected by soldering to the second set of surface electrodes 98. Instead of formation of the gap between the electrodes 86 and 98, a chip capacitors can be provided on the electrodes 86 to thereby realize a larger coupling capacitance. If necessary, as shown in FIGS. 27A and 27B, a capacitor can be formed, with a direct utilization of the property of the dielectric block 30, by combination of the central conductive film of the resonance aperture 32 and a newly formed conductive film 100 coated on the wall of the shoulder 80 surrounded by the uncoated, non-conductive portions as shown in FIG. 27A.

Figure 28:
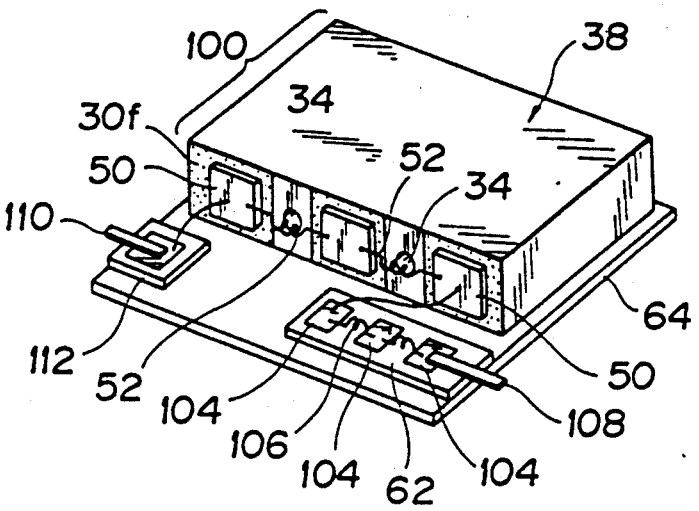
FIG. 28 is a perspective view of a dielectric filter according to a further embodiment of the invention.

FIG. 28 shows a dielectric filter incorporating the dielectric resonator shown in the previous embodiments of, for example, FIGS. 1A and 1B and a band-rejection filter portion and a low-pass filter portion. The dielectric resonator 38 is provided with planar-type capacitors 50 to the open ends 30*f* of the resonance apertures 32 (FIG. 1A) and the capacitors are connected to each ather by coils 52 to form a band-rejection filter portion 102 The capacitors 50 can be fixed in position by soldering by using rivet-like terminals as illustrated by reference numeral 36 in FIG. 1B. Instead of using the rivet-like terminals, a conductive pattern can be formed on the open side 30*f* of the resonator aperture 32 as similar as that shown in FIGS. 20 and 21.

Figure 29:
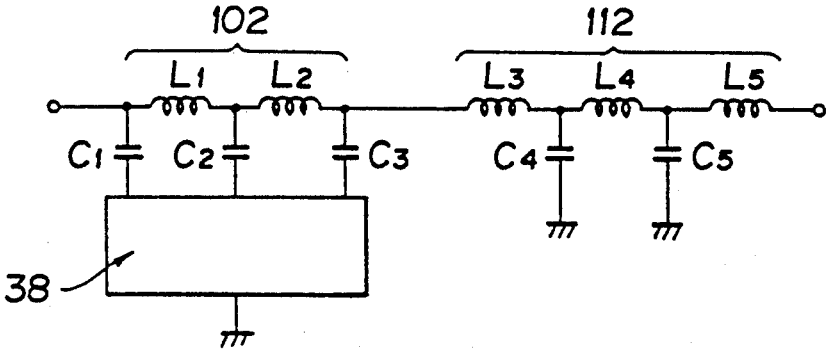
Figure 30A:
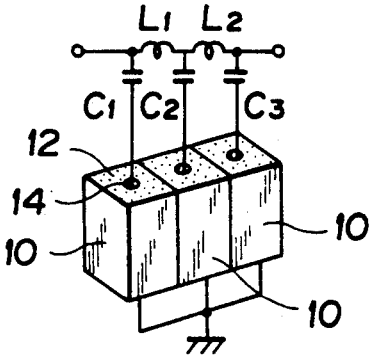
FIG. 30A (PRIOR ART)
FIGS. 30A and 30B show an example of the conventional band-rejection filter and FIG. 31 show its filter characteristic.
Figure 30B:
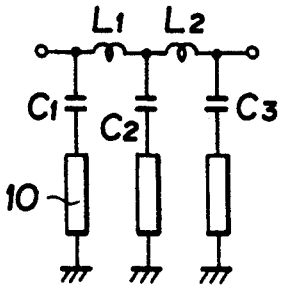
FIG. 30B (PRIOR ART)
Figure 31:
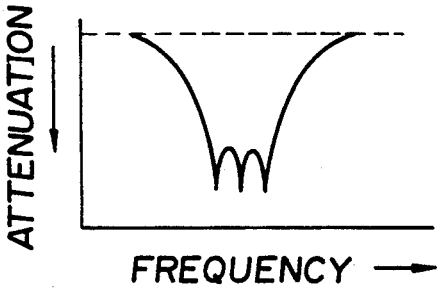
Figure 33:
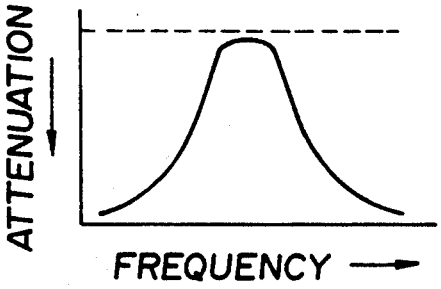
FIGS. 32A and 32B show an example of the conventional band-pass filter and FIG. 33 show its filter characteristic.
Figure 32A:
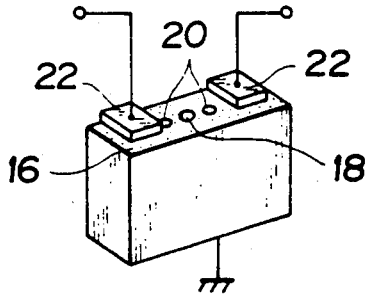
FIG. 32A (PRIOR ART)
Figure 32B:
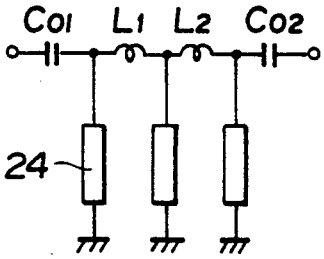
FIG. 32B (PRIOR ART)

In the embodiment of FIG. 28, the dielectric resonator 38 is placed directly on a metal base plate 64 and fixed thereto by soldering or using a suitable conductive adhesive agent. A dielectric substrate 62 having a low-pass filter portion is also disposed on the metal base plate 64. The dielectric substrate 62 has a plurality of surface electrodes 104 and a ground electrode (not shown) and the surface electrodes 104 are connected to each other by coils 106. The dielectric substrate 62 is positioned closed to the open side 30*f* of the dielectric resonator 38 and a terminal 108 is connected to the outer electrode 104. The other terminal 110 is disposed on a terminal substrate 112 which is insulatively fixed to the metal base plate 64. Thus, a filter circuit is obtained as shown in FIG. 29. In the illustrated embodiment, a low-pass filter portion 113 is disposed on the output side of the band-rejection filter portion 102. The circuit has suitable lumped element circuits integrated circuit elements ($L_1$, $L_2$, $C_1$, $C_2$, $C_3$) to provide a band-rejection filter portion 102 and suitable lumped element circuits ($L_3$, $L_4$, $L_5$, $C_4$, $C_5$) to provide a low-pass filter portion 113 and thus the combination provides an band-rejection filter having improved characteristics in a high frequency range above $2f_o$ (resonance frequency). Though not shown, two low-pass filter portions can be disposed on both input and output sides of the band-rejection filter. Further, if desired, two dielectric substrates as the substrate 62 in FIG. 28 can be disposed on opposed sides of the base plate 64 with the dielectric resonator positioned therebetween, not shown.

What is claimed is:

1. A dielectric filter comprising:

a dielectric block having:

a plurality of resonance apertures positioned a predetermined distance from each other and each of said plurality of resonance apertures extending through said dielectric block;

a non-conductive open side on an outer side of said dielectric block having an end of each of said plurality of resonance apertures extending there through;

a plurality of recesses, each of said plurality of recesses formed between respective adjacent ones of said plurality of resonance apertures along said open side of said dielectric block; and a plurality of decoupling apertures, each of said plurality of decoupling apertures formed within a respective one of said plurality of recesses and extending through said dielectric block for electromagnetically shielding adjacent resonance apertures;

an electrically conductive film extending along the surface of said plurality of resonance apertures, said plurality of decoupling apertures, said plurality of recesses and each outer surface of said dielectric block except for said open side, for electrically connecting opposite sides of said plurality of decoupling apertures with outer surfaces of said dielectric block covered by said conductive film; and a plurality of coils, each of said plurality of coils being received in a respective one of said plurality of recesses and connected between respective adjacent ones of said plurality of resonance apertures.

2. A filter according to claim 1, further comprising a plurality of capacitors wherein each of said plurality of capacitors is connected to a respective one of said plurality of resonance apertures at said non-conductive open side, and said plurality of capacitors are connected to each other by said plurality of coils.

3. A band rejection filter comprising:

a dielectric filter comprising:

a dielectric block, having:

a plurality of resonance apertures positioned a predetermined distance from each other and each of said plurality of resonance apertures extending through said dielectric block, a non-conductive open side on an outer side of said dielectric block having an end of each of said resonance apertures extending therethrough;

a plurality of decoupling apertures, wherein each of said plurality of decoupling apertures are between and in parallel to respective ones of said plurality of resonance apertures for shielding electromagnetically adjacent resonance apertures with each other; and a longitudinal shoulder on one longitudinal edge of the open side;

an electrically conductive film extending entirely along a surface of said plurality of resonance apertures, said plurality of decoupling apertures, adjacent said decoupling aperture and an outer surface of said dielectric block except a surface of said non-conductive open side to provide central conductor portions in said plurality of resonance apertures, outer conductor portions on outer surfaces of said dielectric block and electrically connecting opposite sides of said plurality of decoupling apertures with said outer conductive portions of said dielectric block; and a plurality of first conductive patterns formed around a respective one of said plurality of resonance apertures; and a capacitor substrate comprising:

a dielectric plate having a length equal to the dielectric resonator;

a plurality of first electrodes spaced along a top surface of the dielectric plate;

a ground electrode disposed on a bottom surface of the dielectric plate and connected to a ground;

a plurality of coils connected between respective ones of said plurality of first electrodes;

a first terminal connected to a first of said plurality of first electrodes at first end of the dielectric plate;

a second terminal connected to a second of said plurality of first electrodes at a second end of the dielectric plate; and a longitudinal pattern on the top surface of the dielectric plate connecting the capacitor substrate to the longitudinal shoulder of the dielectric filter.

4. A band rejection filter as claimed in claim 3, wherein said dielectric filter further comprises a plurality of second conductive patterns spaced and extending along an edge of the open side of said dielectric block wherein each of said plurality of second conductive patterns are positioned below a respective one of said plurality of first conductive patterns to form a coupling capacitance.

5. A band rejection filter as claimed in claim 3, wherein said capacitor substrate further comprises a plurality of second electrodes positioned along the top surface of said dielectric plate and spaced from a respective one of said plurality of first electrodes to form a coupling capacitance between respective ones of said plurality of first and second electrodes.

6. A band rejection filter comprising:

a dielectric filter comprising:

a dielectric block, having:

a plurality of resonance apertures positioned a predetermined distance from each other and each of said plurality of resonance apertures extending through said dielectric block, a non-conductive open side on an outer side of said dielectric block having an end of each of said resonance apertures extending therethrough;

a plurality of decoupling apertures, wherein each of said plurality of decoupling apertures are between and in parallel to respective ones of said plurality of resonance apertures for shielding electromagnetically adjacent resonance apertures with each other;

an electrically conductive film extending entirely along a surface of said plurality of resonance apertures, said plurality of decoupling apertures, adjacent said decoupling aperture and an outer surface of said dielectric block except a surface of said non-conductive open side to provide central conductor portions in said plurality of resonance apertures, outer conductor portions on outer surfaces of said dielectric block and electrically connecting opposite sides of said plurality of decoupling apertures with said outer conductive portions of said dielectric block;

a plurality of capacitors, each connected to a respective one of said plurality of resonance apertures;

a plurality of coils connected between respective ones of said plurality of capacitors connecting said plurality of capacitors to one another; and a metal base plate connected on a top side to said dielectric filter comprising:

a first dielectric substrate placed on said top side of the metal plate;

a plurality of first electrodes spaced along a top surface of the first dielectric substrate;

a plurality of coils connected between respective ones of said plurality of first electrodes;

a first terminal connected to one of said plurality of first electrodes;

a second dielectric substrate placed on a top side of the metal base plate;

a second electrode placed on a top side of said second dielectric substrate;

a second terminal connected to said second electrode.

* * * * *